US008734262B1

(12) United States Patent
Yovanovich et al.

(10) Patent No.: US 8,734,262 B1
(45) Date of Patent: May 27, 2014

(54) BILLIARD BALL RACK POSITIONING SYSTEM AND USE THEREOF

(76) Inventors: David A. Yovanovich, Salt Lake City, UT (US); Mark A. Vester, Juneau, AK (US)

( * ) Notice: Subject to any disclaimer, the term of this patent is extended or adjusted under 35 U.S.C. 154(b) by 200 days.

(21) Appl. No.: 12/236,451

(22) Filed: Sep. 23, 2008

(51) Int. Cl.
*A63D 15/00* (2006.01)

(52) U.S. Cl.
CPC ..... *A63D 15/005* (2013.01); *A63D 15/00* (2013.01)
USPC ..... 473/40; 473/41; 473/21; 473/22; 473/26

(58) Field of Classification Search
CPC ... A63D 15/005; A63D 15/00; A63D 15/006; A63D 5/08; A63D 9/00
USPC ..... 473/26, 40, 41, 21, 22
See application file for complete search history.

(56) References Cited

U.S. PATENT DOCUMENTS

| | | | | |
|---|---|---|---|---|
| 2,264,746 | A | 12/1941 | Ellwood | 200/87 |
| 3,466,038 | A * | 9/1969 | Hill | 473/4 |
| 4,422,637 | A | 12/1983 | Bush | 273/22 |
| 4,553,750 | A | 11/1985 | Kintz | 273/22 |
| 6,024,649 | A | 2/2000 | Tudek et al. | 473/40 |
| 6,371,860 | B1 * | 4/2002 | Anderson | 473/1 |
| 6,609,307 | B1 | 8/2003 | Haynes et al. | 33/286 |
| 6,629,897 | B2 * | 10/2003 | Belknap | 473/40 |
| 7,063,620 | B2 | 6/2006 | Nearhood | 473/2 |
| 7,118,486 | B2 | 10/2006 | Evers | 473/2 |
| 7,165,332 | B2 | 1/2007 | McGrail et al. | 33/286 |
| 7,448,954 | B1 * | 11/2008 | Reynolds | 473/40 |
| 2003/0059752 | A1 | 3/2003 | Gratkowski et al. | 434/247 |
| 2004/0132535 | A1 * | 7/2004 | Sumko | 473/2 |
| 2005/0239566 | A1 | 10/2005 | Nearhood | 473/40 |
| 2006/0042105 | A1 | 3/2006 | McGrail et al. | 33/286 |

OTHER PUBLICATIONS

Hall Effect Sensor, Wikipedia, Aug. 30, 2008.
Proximity Sensor, Wikipedia, Aug. 30, 2008.
Reed Switch, Wikipedia, Aug. 30, 2008.

* cited by examiner

*Primary Examiner* — Mitra Aryanpour
(74) *Attorney, Agent, or Firm* — Michael R. Schramm

(57) ABSTRACT

The improved billiard ball rack positioning system is an invention that allows a user to quickly and easily position a billiard ball type rack. The rack of the system includes a plurality of position indicating LEDs and a plurality of proximity sensors mounted thereon. Proper positioning of the rack at a predetermined location on a playing surface or table causes actuation of the proximity sensors and consequently lighting of the indication lights. Lighting of all of the indication lights functions as an indication to the user that the rack is properly positioned. In contrast to prior art devices, the improved billiard ball rack positioning system provides for a "go/no-go" type of position indication means.

26 Claims, 5 Drawing Sheets

BILLIARD BALL RACK POSITIONING SYSTEM AND USE THEREOF

BACKGROUND OF THE INVENTION

1. Field of the Invention

This invention relates to racks and like devices for use in "racking" or position balls such as billiard balls into a proper formation and position such as a triangular formation properly positioned on a billiard table in preparation to initiate a game such as a game of billiards.

2. Description of the Related Art

In playing the game of billiards or pool or the like, it is important to achieve not only a "tight rack" of balls or balls that have been tightly racked, so that when breaking the rack of balls such as with a cue ball, the balls will efficiently transmit energy into surrounding balls and achieve a good break, but it is also important to properly position the set of racked balls to as to provide for consistent and fair play. Heretofore such proper positioning of a set of racked balls was commonly achieved by attempting to position the lead ball over a point marked on a billiard table. When the point marked on the table is covered by a ball, the user is left to estimate the proper position of the racked balls. Billiard tables commonly have marks on the sides of the tables that further assist in positioning the balls but such marks still require signification estimation on the part of the user. The disclosed invention seeks to overcome the noted problems with positioning racked balls.

Many improvements to racks or rack like devices have been devised to improve the racking of balls. For instance, the following list of US patents and applications all disclose inventions related to positioning of billiard type racks and are incorporated herein by reference: U.S. Pat. Nos. 4,422,637, 4,553,750, 6,024,649, 6,609,307, 7,063,620, 7,118,486, 7,165,332, 20030059752, 20040132535, 20050239566 and 20060042105. However, the inventive concepts disclosed in the preceding list of patents include several deficiencies. Problems with the prior art include for instance complicated racks having moving parts, racks that require the user to estimate when the rack is properly positioned, and the absence of a sure go/no-go type positioning indication means.

SUMMARY OF THE INVENTION

The present invention has been developed in response to the present state of the art, and in particular, in response to the rack devices that were described to be lacking in the art. Accordingly, the present invention is an improved rack positioning system that comprises a billiard type table having at least one magnetic target imbedded therein at predetermined positions, and a substantially triangular shaped billiard ball rack having first and second position sensors, first and second position indication lights, and an electrical power source mounted thereon. The system is adapted such that when the rack is properly positioned, the first sensor is in substantially close proximity to the first magnetic target and the second sensor is in substantially close proximity to the second magnetic target. With the sensors thus positioned, the sensors are magnetically actuated by the magnetic targets and close to complete the respective sensor circuits causing the first and second position indication lights to light or turn on. When both first and second position indication lights are lighted, the rack is properly positioned.

Reference throughout this specification to features, advantages, or similar language does not imply that all of the features and advantages that may necessarily be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
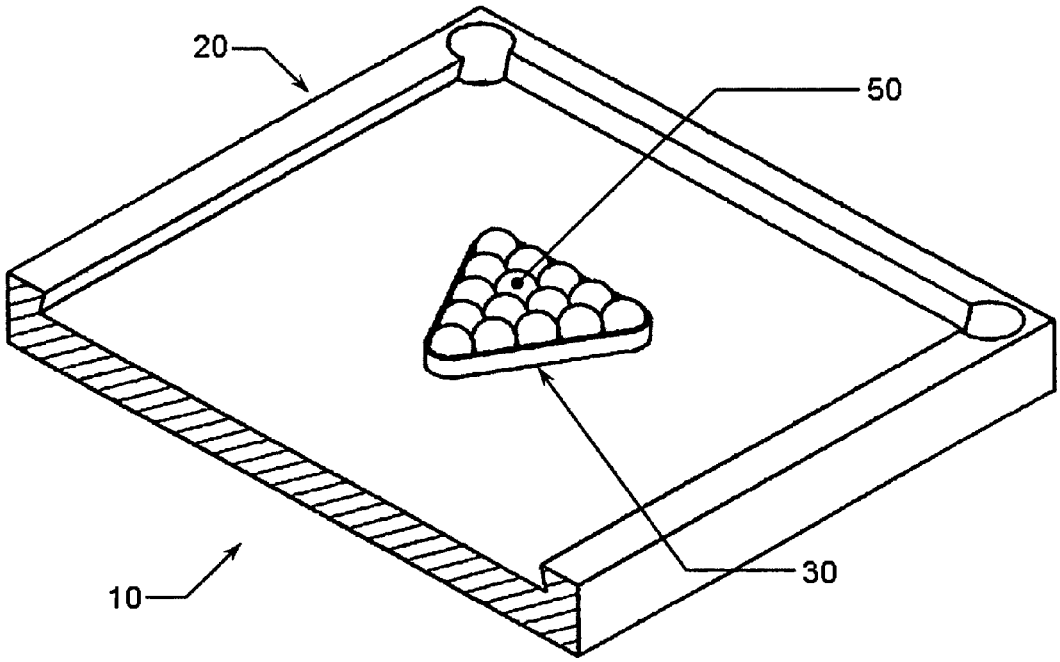
FIG. 1 is an isometric view of a first embodiment of the rack positioning system.
Figure 2:
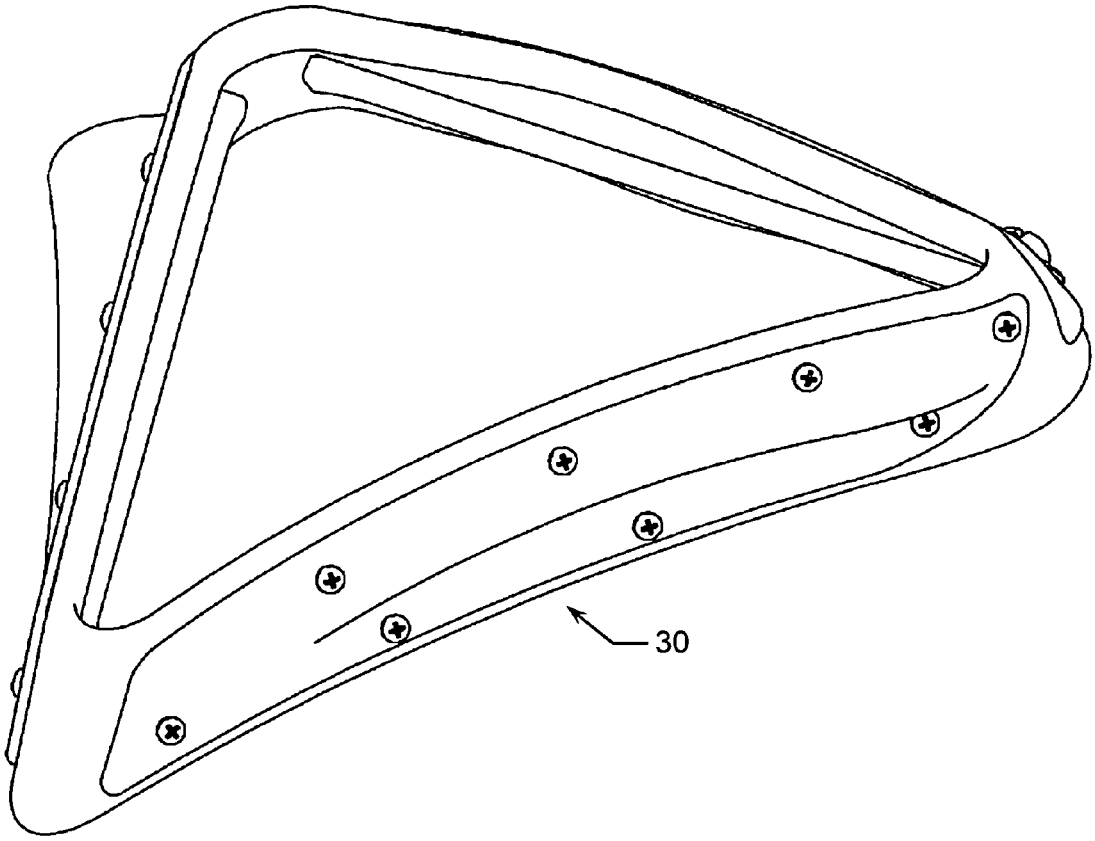
FIG. 2 is an enlarged isometric view of a first embodiment of the rack assembly.
Figure 3:
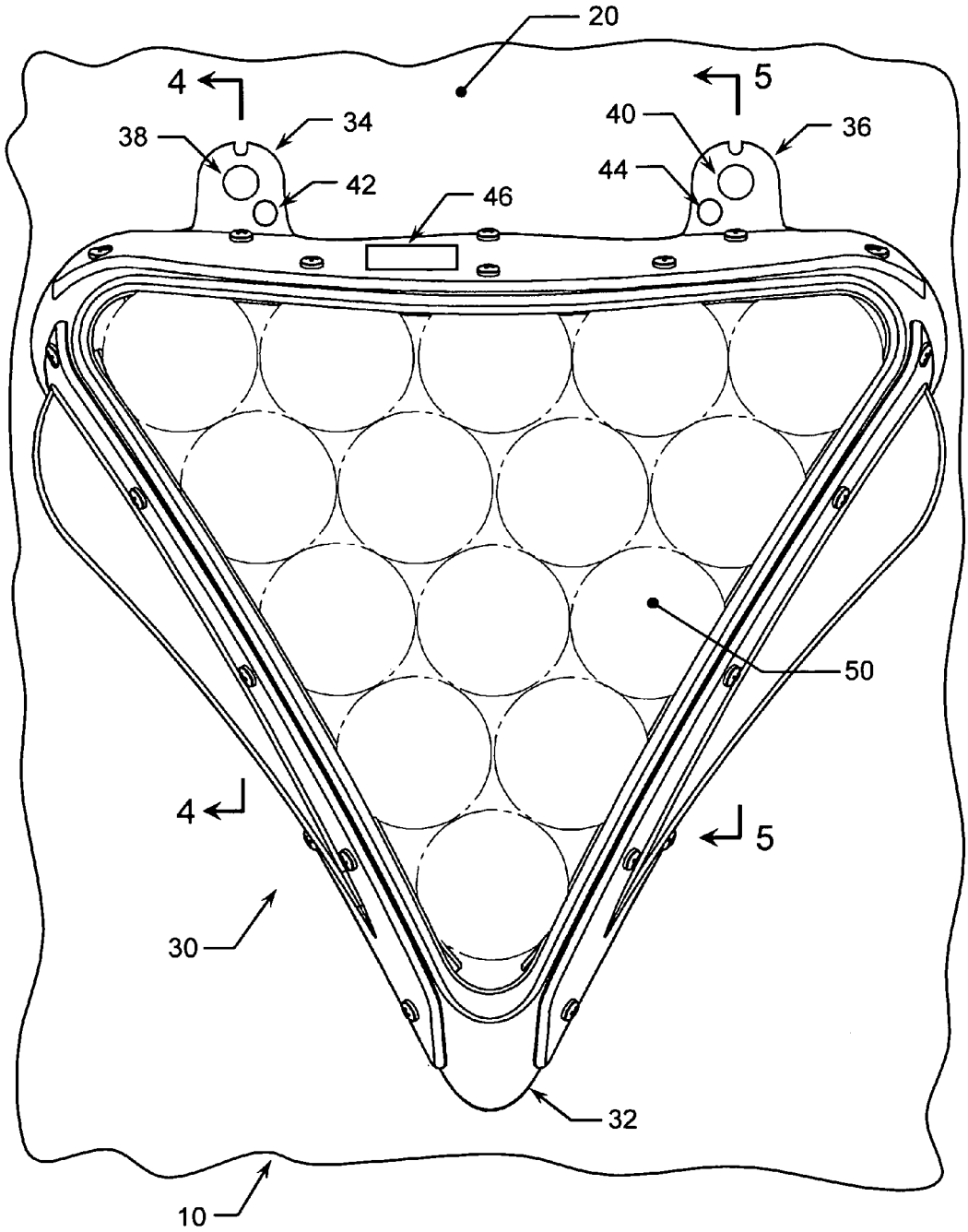
FIG. 3 is a plan view of a first embodiment of the rack positioning system, billiard balls are shown for reference in the rack.
Figure 4:
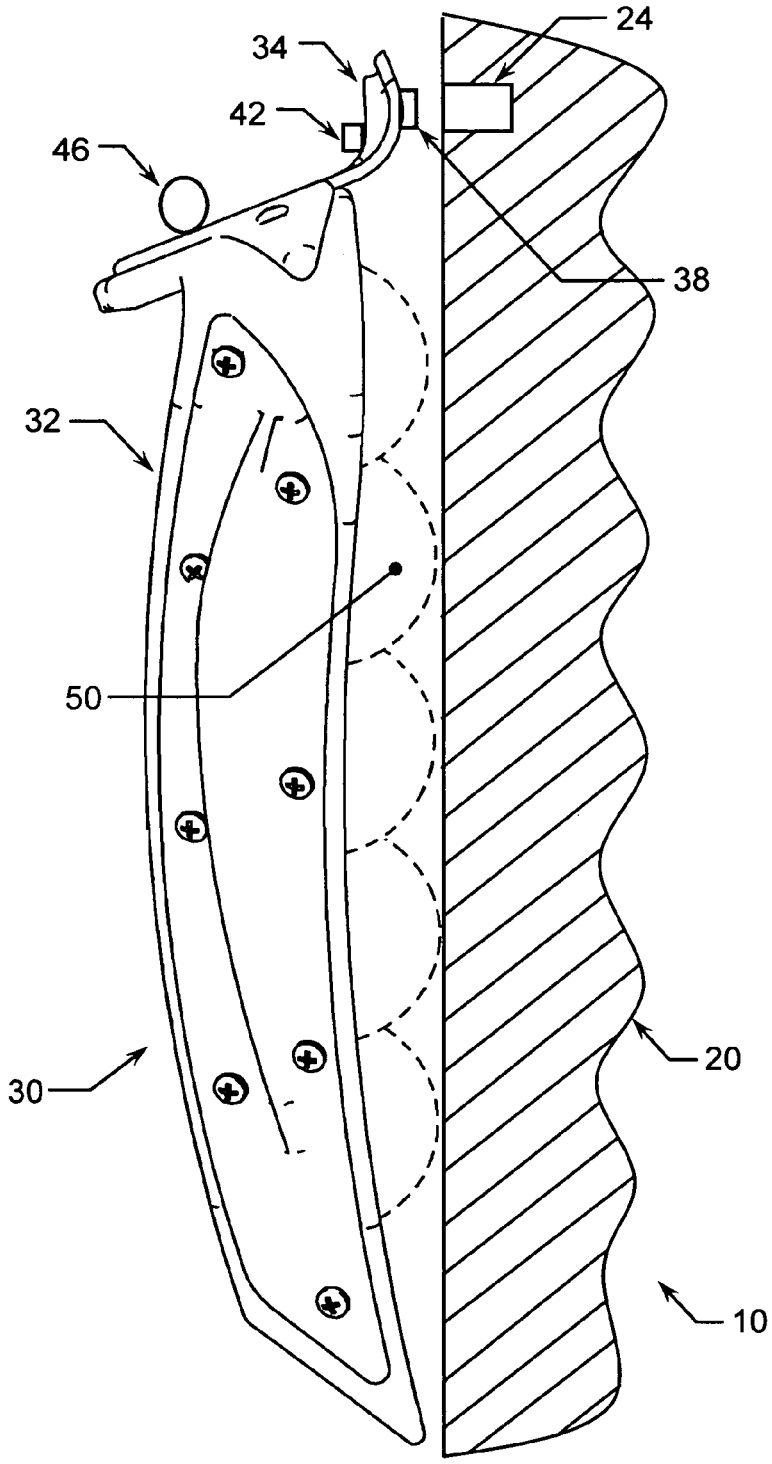
FIG. 4 is a side view of a first embodiment of the rack positioning system taken substantially at the location indicated in FIG. 3 by the view indication arrows associated with FIG. 4 with the billiard table and magnetic target shown as a cross-sectional view.
Figure 5:
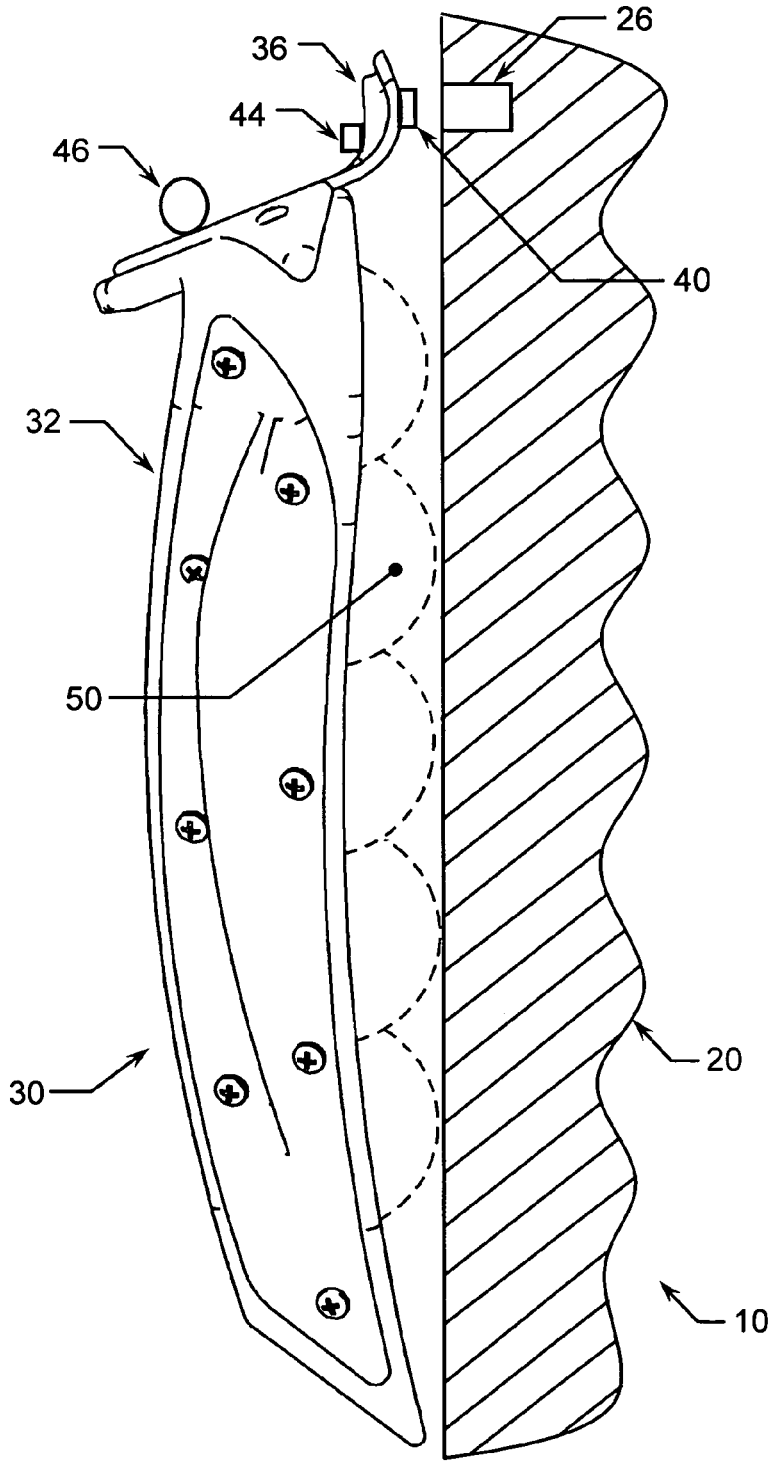
FIG. 5 is a side view of a first embodiment of the rack positioning system taken substantially at the location indicated in FIG. 3 by the view indication arrows associated with FIG. 5 with the billiard table and magnetic target shown as a cross-sectional view.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention.

One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The invention is an improved rack positioning system for properly positioning a rack of billiard balls or like. The invention includes a billiard rack that cooperatively functions with a billiard table such that when the rack is properly positioned, both of the rack's position indication lights are lighted. In order to facilitate the understanding of the present invention in reviewing the drawings accompanying the specification, a feature list is provided below. It is noted that like features are like numbered throughout all of the figures.

FEATURE TABLE

| # | Feature |
|---|---|
| 10 | Rack Positioning System |
| 20 | Billiard Table |
| 24 | First Magnetic Target |
| 26 | Second Magnetic Target |
| 30 | Rack Assembly |
| 32 | Rack |
| 34 | Rack First Foot |
| 36 | Rack Second Foot |
| 38 | First Reed Switch |
| 40 | Second Reed Switch |
| 42 | First Light |
| 44 | Second Light |
| 46 | Battery |
| 50 | Billiard Balls |

Referring now to the drawings, a first embodiment of the invention is a rack positioning system 10 for use in properly positioning a set of billiard balls 50 comprising a billiard table 20 and a rack assembly 30. Billiard table 20 further defines a substantially conventional type billiard table except that table 20 includes a first magnetic target 24 and a second magnetic target 26 embedded into table 20. Magnetic targets 24 and 26 define magnets of predetermined geometry and magnetic strength that are preferably embedded in table 20 such that targets 24 and 26 cause reed switches 38 and 40 of rack assembly 30 to actuate when reed switches 38 and 40 are in near proximity to targets 24 and 26 and yet such that targets 24 and 26 do not cause any interruption to the travel or travel path of a billiard ball when a billiard ball rolls on or near targets 24 and 26. Magnetic targets 24 and 26 are further positionally embedded into table 20 in such positions that when reed switches 38 and 40 of rack assembly 30 are in near proximity to targets 24 and 26, rack assembly 30 is in the proper predetermined position.

Rack assembly 30 further defines an assembly of a rack 32, a first reed switch 38, a second reed switch 40, a first position indication light 42, a second position indication light 44 and a battery 46.

Rack 32 defines a substantially conventional triangular shaped rack having a first foot 34 and a second foot 36 extending from a side of rack 32. First reed switch 38 and second reed switch 40 define conventional electromagnetic type reed switches such as are commonly known in the art. Such a reed switch is taught in the disclosed Aug. 30, 2008 "Reed Switch" Wikipedia article and in U.S. Pat. No. 2,264,746 titled electromagnetic switch, both of which are expressly incorporated herein in their entirety. Reed switches 38 and 40 are adapted such that when reed switches 38 and 40 are in close proximity to a magnet, the magnetic pull of the magnet causes reed switches 38 and 40 to close, thus completing an electrical circuit. First light 42 and second light 44 define lights such as are commonly known in the art and preferably define light emitting diode or LED type lights. Battery 46 defines a conventional battery such as is commonly known in the art and such that is able to power lights 42 and 44.

Rack assembly 30 is assembled such that first reed switch 38 is mounted to first rack foot 34, second reed switch 40 is mounted to second rack foot 36 and battery 46 is mounted to a side of rack 32. Rack assembly 30 is further assembled such that first reed switch 38 is electrically connected to battery 46 such that when first reed switch 38 is actuated or closed, the electrical circuit between first reed switch 38 and battery 46 is completed and first light 42 is lighted, and such that second reed switch 40 is electrically connected to battery 46 such that when second reed switch 40 is actuated or closed, the electrical circuit between second reed switch 40 and battery 46 is completed and second light 44 is lighted.

In practice, assembled rack assembly 30 is placed upon the surface of billiard table 20. Billiards balls 50 are preferably placed within rack assembly 30. Rack assembly 30 is moved or adjusted on the surface of table 20 until first foot 34 is positioned in near proximity to first magnetic target 24 and until second foot 36 is positioned in near proximity to second magnetic target 26. The described positioning of rack assembly 30 further causes first reed switch 38 to be positioned in near proximity to first magnetic target 24 and second reed switch 40 to be positioned in near proximity to second magnetic target 26. Such positioning of reed switches 38 and 40 cause lights 42 and 44 respectively to be lighted. The lighting of both of lights 42 and 44 function as an indication to the user that rack assembly 30 is properly positioned. It is noted that if either one or none of lights 42 and 44 are lighted, rack assembly 30 is not properly positioned. It is yet further noted that inasmuch as rack assembly 30 rests upon table 20, adjustment of rack assembly 30 need only be performed in an X-Y plane as the Z component of movement is fixed due to the surface of table 20. It is also further noted that the sensitivity of rack assembly 30 may be adapted as needed by, for instance, modifying the size and magnetic strength of magnetic targets 24 and 26. For instance, the less the magnetic strength and the smaller the size of targets 24 and 26, the closer or more precisely electromagnetic reed switches 38 and 40, and consequently rack assembly 30, need to be positioned in order to active lights 42 and 44.

In a first alternate embodiment, lights 42 and 44 define LEDs that are adapted to display at least two colors, and in particular the colors of red and green. The first alternate embodiment is substantially identical to the first embodiment except that rather than have a light-off mode that corresponds to an improper rack position and a light-on mode that corresponds to a proper rack position, in the first alternate embodiment, a red light-on mode corresponds to an improper rack position and a green light-on mode corresponds to a proper rack position. In this embodiment, the user is assured that rack assembly 32 is powered even when rack assembly 32 is not yet positioned.

In a second alternate embodiment, the second alternate embodiment is substantially identical to the first embodiment except that rather than incorporating an electromagnetic reed switch, the second alternate embodiment incorporates a Hall Effect sensing proximity switch. Such Hall Effect sensing switches are well known in the art. Such a Hall Effect sensor switch is taught in the disclosed Aug. 30, 2008 "Hall Effect Sensor" Wikipedia article which is expressly incorporated herein in its entirety.

In a third alternate embodiment, the third alternate embodiment is substantially identical to the first embodiment except that rather than incorporating an electromagnetic reed switch, the third alternate embodiment incorporates a photoelectric sensing proximity switch. Such photoelectric sensing proximity switches are well known in the art. Such a Hall Effect sensor switch is taught in the disclosed Aug. 30, 2008 "Proximity Sensor" Wikipedia article which is expressly incorporated herein in its entirety.

In a fourth alternate embodiment, the fourth alternate embodiment is substantially identical to the first embodiment except that rather than reed switches 38 and 40, lights 42 and 44, and battery 46 being mounted to rack 32, reed switches 38 and 40, lights 42 and 44, and battery 46 are mounted to billiard table 20, and rather than magnetic targets 24 and 26 being embedded in billiard table 20, magnetic targets 24 and 26 are connected to rack 32 to form rack assembly 30. The method of use of the fourth embodiment is otherwise substantially similar to the use of the first embodiment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A system for positioning a rack, said system comprising:
a rack for containing balls;
a positioning surface for positioning said rack;
at least one magnetic target embedded within said positioning surface;
at least one sensor connected to said rack;
and at least one position indication device;
wherein when said rack is positioned upon said positioning surface in predetermined proximity to said at least one magnetic target, said at least one sensor is actuated, and wherein said actuation of said at least one sensor causes said at least one position indication device to activate.

2. The system of claim 1, wherein said rack defines a billiard ball rack.

3. The system of claim 1, wherein said at least one position indication device defines at least one light.

4. The system of claim 1, wherein said at least one position indication device defines a plurality of position indication devices.

5. The system of claim 1, wherein said at least one position indication device defines a plurality of position indication devices, and wherein when all of said position indication devices are activated said rack is properly positioned.

6. The system of claim 1, wherein said at least one sensor defines a plurality of sensors.

7. The system of claim 1, wherein said at least one sensor defines at least one sensor of the following group of sensors comprising an electromagnetic reed switch sensor and a hall effect switch.

8. The system of claim 1, wherein said positioning surface defines a playing surface of a billiard table.

9. The system of claim 1, wherein said positioning surface defines a playing surface of a billiard table, and wherein said billiard table includes a plurality of magnetic targets embedded within said billiard table.

10. The system of claim 1, wherein said positioning surface defines a playing surface of a billiard table, and wherein said billiard table includes a plurality of magnetic targets embedded within said billiard table, and wherein said at least one sensor, said at least one position indication device and an electrical power source are mounted to said rack.

11. The system of claim 10, wherein said at least one sensor defines a plurality of sensors, and wherein said at least one position indication device defines a plurality of position indication lights, and wherein each of said magnetic targets are embedded in said billiard table at a different location on said billiard table, and wherein each of said sensors are mounted to said rack at a different location on said rack, and wherein each of said sensors corresponds to a different position indication light, and wherein when each of said sensors are in predetermined proximity to a unique magnetic target of said magnetic targets, all of said position indication lights are lighted said rack is properly positioned.

12. The system of claim 1, wherein said positioning surface defines a playing surface of a billiard table, and wherein said billiard table includes at least one sensor, at least one indication device, and an electrical power source connect to said billiard table, and wherein said rack includes at least one magnet connected to said rack.

13. The system of claim 12, wherein said at least one magnetic target defines a plurality of magnetic targets, and wherein said at least one sensor defines a plurality of sensors, and wherein said at least one position indication device defines a plurality of position indication lights, and wherein each of said magnetic targets are connected to said rack at a different location on said rack, and wherein each of said proximity sensors are mounted to said billiard table at a different location on said billiard table, and wherein each of said proximity sensors corresponds to a different position indication light, and wherein when each of said sensors are in predetermined proximity to a unique magnetic target of said magnetic targets, all of said position indication lights are lighted said rack is properly positioned.

14. The system of claim 1, wherein said rack includes a plurality of balls contained within said rack.

15. The system of claim 3, wherein said activation defines the lighting of said at least one position indication light, and wherein said lighting includes the change of lighted color of said at least one position indication light.

16. A ball rack for positioning balls, said rack comprising:
a frame for containing balls having at least one wall;
at least one sensor mounted to said frame;
an electrical power source for providing electrical power mounted to said frame; and
at least one position indication device mounted to said frame;
wherein when said rack is positioned in predetermined proximity to at least one magnetic target, said at least one sensor is actuated, and wherein said actuation of said at least one proximity sensor causes said at least one position indication device to activate; and
wherein said predetermined position defines a position in substantially near proximity to a plurality of magnetic targets embedded in said different locations in a billiard table, and wherein said at least one sensor defines a plurality of sensors, and wherein said at least one position indication device defines a plurality of position indication lights and wherein each of said sensors are mounted to said rack at a different location on said rack, and wherein each of said sensors corresponds to a different position indication light, and wherein when all of said position indication lights are lighted said rack is properly positioned.

17. The ball rack of claim 16, wherein said rack defines a billiard ball rack.

18. The ball rack of claim 16, wherein said at least one position indication device defines at least one light.

19. The ball rack of claim 16, wherein said at least one position indication device defines a plurality of position indication devices.

20. The ball rack of claim 16, wherein said at least one position indication device defines a plurality of position indication devices, and wherein when all of said position indication devices are activated said rack is properly positioned.

21. The ball rack of claim 16, wherein said at least one sensor defines a plurality of sensors.

22. The ball rack of claim 16, wherein said at least one sensor defines at least one sensor of the following group of sensors comprising an electromagnetic reed switch sensor and a hall effect switch sensor.

23. The ball rack of claim 16, wherein said predetermined position defines a position in substantially near proximity to a plurality of magnetic targets.

24. The ball rack of claim 16, wherein said predetermined position defines a position in substantially near proximity to a plurality of magnetic targets embedded in a billiard table.

25. The ball rack of claim 16, wherein said rack includes a plurality of balls contained within said rack.

26. The ball rack of claim 19, wherein said activation defines the lighting of said at least one position indication light, and wherein said lighting includes the change of lighted color of said at least one position indication light.

* * * * *